US007670231B1

(12) United States Patent
Greene

(10) Patent No.: US 7,670,231 B1
(45) Date of Patent: Mar. 2, 2010

(54) GOLF BALL ALIGNMENT DEVICE HAVING PHYSICAL AND OPTICAL ALIGNMENT MEMBERS

(76) Inventor: Phillip R. Greene, 2567 Selwyn Ave., Charlotte, NC (US) 28209

( * ) Notice: Subject to any disclaimer, the term of this patent is extended or adjusted under 35 U.S.C. 154(b) by 0 days.

(21) Appl. No.: 12/495,041

(22) Filed: Jun. 30, 2009

(51) Int. Cl.
*A63B 69/36* (2006.01)

(52) U.S. Cl. ..... 473/220; 473/268; 473/257

(58) Field of Classification Search ..... 473/218, 473/219, 220, 257, 261, 262, 264, 266, 268, 473/269, 270, 272
See application file for complete search history.

(56) References Cited

U.S. PATENT DOCUMENTS 3,656,752 A 4/1972 Moriarty
5,211,400 A 5/1993 Hall et al.
5,338,037 A * 8/1994 Toyohara ..... 473/268
5,375,833 A 12/1994 Marier, Jr.
5,375,844 A 12/1994 Waud
5,899,816 A 5/1999 Pearson
7,455,596 B1 11/2008 Greene
2005/0277482 A1 12/2005 Bennett

* cited by examiner

*Primary Examiner*—Nini Legesse
(74) *Attorney, Agent, or Firm*—Adams Intellectual Property Law

(57) ABSTRACT

An alignment device including physical and optical alignment members for aligning an impact point of a golf ball in order to correlate the perceived alignment of the ball by a golfer with the actual direction of impact required to maximize the probability of the ball traveling in the desired direction.

17 Claims, 6 Drawing Sheets

GOLF BALL ALIGNMENT DEVICE HAVING PHYSICAL AND OPTICAL ALIGNMENT MEMBERS

TECHNICAL FIELD AND BACKGROUND OF THE INVENTION

This invention relates to an alignment device for aligning a putter on an intended line that traverses through an impact point of a golf ball resting on the intended line of the putt. Utilizing this device, a golfer is able to correlate the perceived alignment of the ball with the actual direction of impact required to maximize the probability that the ball travels in the desired direction.

The direction in which a golf ball rolls depends on a variety of factors, some of which include the relative "speed" of the green, the slope, the lie of the ground beneath the ball, and the way in which the golfer sets up, or "addresses," the ball. It is the combination of these factors that affect how the ball is struck and rolls. While the skilled golfer is able to consistently control the setup, judging the speed and slope of every green comes with years of practice and experience. Greens may have any type, or combination of types, of slopes that must be considered when addressing the ball, such as a straight flat lie, straight downhill lie, straight uphill lie, left to right uphill lie, left to right downhill lie, right to left uphill lie, left to right downhill lie, straight sidehill lie that ultimately breaks left, and straight sidehill lie that ultimately breaks right.

Aside from the environmental factors, there is a perceptual factor based on parallax between the position of the player's body and the ball that affects the ability of the golfer to translate what is perceived as the required direction of impact on the ball, into the direction of actual impact. If the body, particularly the head, eyes and shoulders, is not correctly aligned, the player will believe that the ball is being struck in the desired direction, when in fact the ball is being struck in an undesired direction.

The principle behind the invention described in this application is that the more closely and consistently the ball is positioned in a substantially bi-directionally perpendicular orientation under the dominant eye of the golfer, or at least at an angle in which a golfer can learn to recognize and repeatedly position his/her dominant eye regardless of the slope of the putting surface, the greater the probability that the putter will be aligned properly behind the ball, so that the ball will be struck in the desired direction. The term "perpendicular" as used herein is intended to refer to the position of the eye line in relation to the ball as it lies on the putting surface, and the term "bi-directional" is intended to refer to the visual bisecting of the ball by the device when the eye line is perpendicular to the putting surface. As the impact on the backside of the ball occurs, it is the intended line of the putt as it intersects the backside of the ball that should be perpendicular with the dominant eye of the golfer.

The reasoning behind the assumption is twofold. First, when the dominant eye is bi-directionally perpendicular to the back of the ball as it rests on the intended line of the putt, the parallax of improper positioning, i.e. inside, outside, in front of, behind or any possible combination, over the ball is reduced or eliminated. Secondly, the ability to swing the putter in a pendulum fashion back and through along the intended line of the putt is optimized and, therefore, maximizes energy transfer more consistently from the putter to the back of the ball, resulting in more consistent distance and direction.

It is known that alignment of the ball is an important factor in translating the intended direction of the ball into the actual direction. Of course, the official rules of play do not permit the use of alignment devices beyond what can be legally applied to the putter head itself, such as positioning lines, a representation of balls directly behind the putter face, and so forth. Thus, proper training should include a means by which a player can learn by repetition in practice the proper place of the dominant eye and weight distribution in relation to the ball, putter head, and the intended line on any particular slope. Practice, trial-and-error correction, and further repetition of the corrected position have been shown to improve positioning of the putter on the intended line behind the ball in a perpendicular position beneath the dominant eye. It should be understood that the term "perpendicular" as used herein does not imply only an exact 90 degree orientation with reference to the putting surface, and may include a position perceived by the player as being perpendicular, even though deviating from perpendicular. Therefore, the invention allows for a golfer to identify and master the preferred setup, even though it may vary slightly from the more technically correct positioning.

This ability to properly position the putter on the intended line behind the ball is then taken to the golf course during play, where the golfer studied the green conditions and slope to determine the appropriate force and direction of the putt, and then applying the perceptual factor to properly strike the ball, causing it to roll in the desired direction.

SUMMARY OF THE INVENTION

To achieve the foregoing, in one aspect an alignment device is provided for aligning an impact point of a golf ball in order to correlate the perceived alignment of the putter on the intended line behind the ball, with the actual direction of impact.

In another aspect, an alignment device is provided for practicing and mastering proper alignment of a putter with a golf ball.

In yet another aspect, an alignment device is provided for practicing a proper setup, stance, weight distribution and balance for putting.

In yet another aspect, an alignment device is provided for practicing properly stroking a golf ball, after proper alignment and setup, in a manner that can be learned and replicated during actual play.

These and other aspects of the invention will be described below in connection with an alignment device for aligning a putter along the intended line of the putt behind the impact point of a golf ball perpendicular to a dominant eye. In one embodiment, the alignment device includes a supportive base for being positioned on a putting surface, an upright member extending perpendicularly upwardly from the base, a physical alignment member extending laterally from the upright member, and an optical alignment member for projecting light onto the putting surface. The physical alignment member and spot of light projected onto the putting surface are used to cooperatively align the eye line of the golfer over the putting line and bi-directionally perpendicular or at a consistently preferred angle to the putting surface, resulting in a proper setup and stroke.

The physical alignment member further includes a cross member that extends in the forward putting direction and backward along the putting line. The cross member is arranged substantially perpendicular to the laterally extending portion, thus forming a "crosshair" for positioning. The optical alignment member includes any conventional light source adapted to project a beam of light onto the putting surface to produce a "spot." The spot and the intersection of the crosshair together are vertically aligned when the dominant eye is properly positioned above the device. The golf ball is placed on the putting surface with its impact point aligned on the spot and with the cross member defining the putting line optically bisecting the golf ball.

According to another embodiment of the invention, the physical alignment member may be attached to the upright member at any predetermined height relative to the base, and the base may define a shape or include indicia indicating the direction of the putt.

According to another embodiment of the invention, a power source may be housed within the base for supplying power to the light source, and the light source may be positioned anywhere on the device so long as the spot can be properly projected onto the putting surface, for example projected substantially vertically from above or at an angle to the putting surface.

According to another embodiment of the invention, an alignment device is provided for aligning an impact point of a golf ball perpendicular to a dominant eye, and includes a base for being positioned on a putting surface, an upright member extending vertically upwardly from the base, a physical alignment member extending laterally from the upright member, an optical alignment member carried on the alignment device for projecting light onto the putting surface, and a power source for powering the light source. The light projected onto the putting surface produces a spot that is vertically aligned with the crosshair in the proper line-of-sight eye position corresponding to a proper body position, pendulum action, force and putter direction at impact. Proper stroke is further achieved by following the putting line with the correct line-of-sight eye position. The spot indicates where the golf ball should be positioned relative to the device, and all, a portion, or none of the spot may be visible from above when the ball is positioned on the putting surface.

According to another embodiment of the invention, vertical alignment of the crosshair and the light spot, or back of the ball, indicate that the dominant eye is properly positioned perpendicular to the slope of the green.

According to another embodiment of the invention, vertical misalignment of the crosshair and the spot indicates single or compound line-of-sight eye position deviations or "alternatives," and an angle with respect to the putting surface.

BRIEF DESCRIPTION OF THE DRAWINGS

Some of the aspects of the invention have been set forth above. Other aspects and advantages of the invention will appear as the description of the invention proceeds when taken in conjunction with the following drawings, in which.

DESCRIPTION OF THE PREFERRED EMBODIMENTS AND BEST MODE

The present invention will now be described more fully hereinafter with reference to the accompanying drawing in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Figure 1:
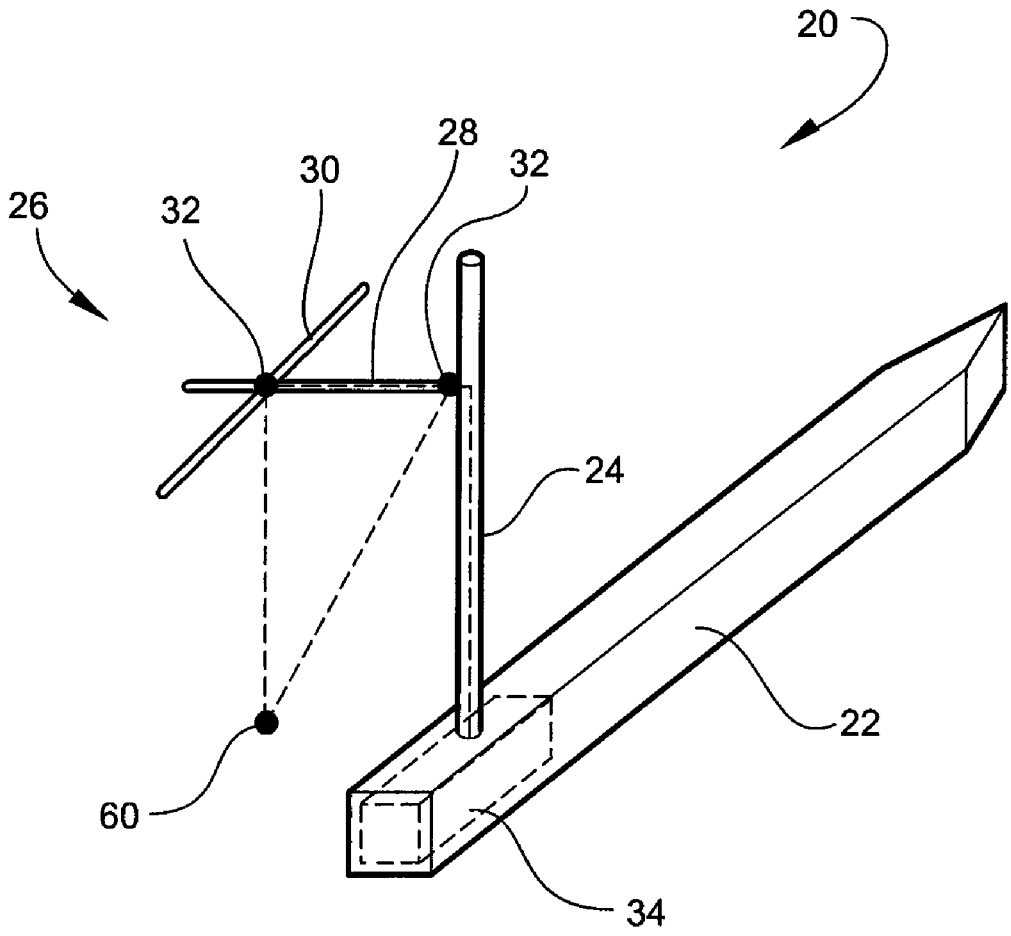
FIG. 1 is a perspective view of an alignment device according to an embodiment of the invention.

Referring now specifically to the drawings, a golf ball alignment device according to the present invention is shown generally in FIG. 1 at reference numeral 20. The alignment device 20 includes a supportive base 22 for being positioned on a putting surface. The base 22 is dimensioned so as to provide stability to the device 20 and to assume the surface orientation of the putting surface beneath. The base 22 may be weighted for stability and have any desired shape. As shown, the base 22 terminates in a directional end indicating the direction of the putt. An upright member 24 extends vertically upwardly from the base 22 and is operable for supporting at least one of the alignment members of the device 20 described in detail below. As shown, the upright member 24 is tubular such that electrical/optical connections associated with an optical alignment member may be routed therethrough. The upright member 24 is configured to rotate relative to the base 22 to accommodate a left- or right-handed golfer.

The device 20 further includes a physical alignment member 26 laterally extending from the upright member 24 at a predetermined distance (i.e., height) from the base 22. The physical alignment member 26 includes a laterally extending member 28 and a cross member 30 perpendicularly intersecting the laterally extending member 28 to form a positioning "crosshair." Members 28 and 30 are coplanar and substantially parallel to the putting surface or base 22. The physical alignment member 26 thus provides a crosshair for dominant eye positioning over the ball. As the cross member 30 extends forward and rearward of the laterally extending member 28, it also indicates the putting or stroke line. The physical alignment member 26 may also be of tubular construction so as to route optical alignment member associated electrical/optical connections therethrough. In an optional embodiment, one end of the cross member 30 may be made substantially longer than the other to accentuate the direction of ball and putter head movement. In a further embodiment, the cross member 30 may include any indicia or marking thereon visible from above as an alternative or additional reference line to the cross member 30. For example, indicia may be provided "inside" or "outside" of the putting line to customize ball positioning based on user preference irrespective of the preferred ball position.

The device 20 further includes an optical alignment member 32 supported by or carried on one of the upright member 24 or physical alignment member 26. As shown in FIG. 1, the optical alignment member 32 is positioned at the intersection of the laterally extending member 28 and cross member 30, or alternatively, at the intersection of the laterally extending member 28 and the upright member 24. It should be understood that the optical alignment member 32 may be positioned anywhere on or relative to the alignment device 20 so long as light is able to be project visible light onto the putting surface vertically beneath the crosshair. The optical alignment member 32 includes a light source configured to project a beam of light onto the putting surface to produce a "spot" 60 on the putting surface for properly positioning a golf ball on the putting surface and aligning with the physical alignment member crosshair.

The light source may include any conventional light source capable of projecting light onto the putting surface that is visible outdoors in daylight. Suitable examples of light sources include, but are not limited to, incandescent bulbs with means for focusing light, focused LEDs, fiber optics, and laser diodes. A preferred light source includes a laser diode such as a laser pointer-type device conventionally known and designed to project a small bright spot of colored light. Laser pointers typically have a low enough power that the projected beam presents a minimal hazard to the eyes for incidental exposure. The laser light may be any color including, but not limited to, red, blue and green. Green laser light may be preferable, as for the same optical power, a green laser will seem brighter than other colors because the human eye is most sensitive at low light levels in the green region of the spectrum (wavelength 520-570 nm), and sensitivity decreases for redder or bluer wavelengths. This apparent increased brightness is advantageous for outdoor daylight environments.

When mounted immediately beneath the crosshair, the optical alignment member 32 projects the beam substantially vertically downward onto the putting surface. When mounted apart from the crosshair, such as at the intersection of the upright member 24 and the laterally extending member 28, the optical alignment member 32 projects the beam to the same position immediately beneath the crosshair from an angle. The optical alignment member 32 is preferably mounted in a stable, non-changing position relative to the physical alignment member 26 so as to avoid misalignment of the members 26 and 32 over time and use.

The device 20 further includes a power source 34 for supplying power to the optical alignment member 32. As shown, the power source 34 is positioned within the base 22 and may be corded or battery powered. A battery powered light source, such as a battery powered laser diode, is the preferred embodiment as the device 20 will most often times be used apart from an electrical outlet and to avoid the inconvenience of a cord traversing the putting surface. Laser diodes further require low power consumption, thus an abundant supply of battery power can be easily accommodated within the base 22 for long-term use. Although not shown, the device 20 further includes a conventional power switch for powering on/off the laser diode or other light source.

Figure 2:
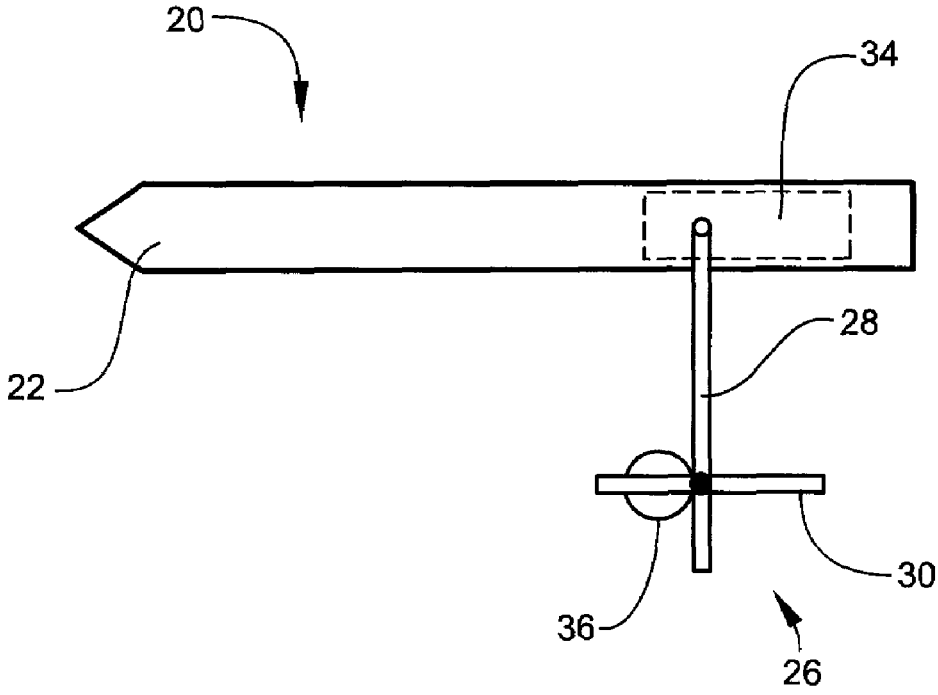
FIG. 2 is a top plan view of the alignment device of FIG. 1 illustrating proper alignment and golf ball positioning.

In use, referring to FIG. 2, the spot 60 projected onto the putting surface is used to properly position the golf ball with respect to the device 20. A first example of proper positioning includes positioning the back of the golf ball 36, or "impact point," directly below the vertically-aligned spot 60 and the intersection of the laterally extending member 28 and cross member 30, with the golf ball 36 visually bisected by the forwardly-extending portion of the cross member 30. Again, the intersection and spot 60 should be vertically aligned when viewed from above with the dominant eye perpendicular to the putting surface.

Figure 3:
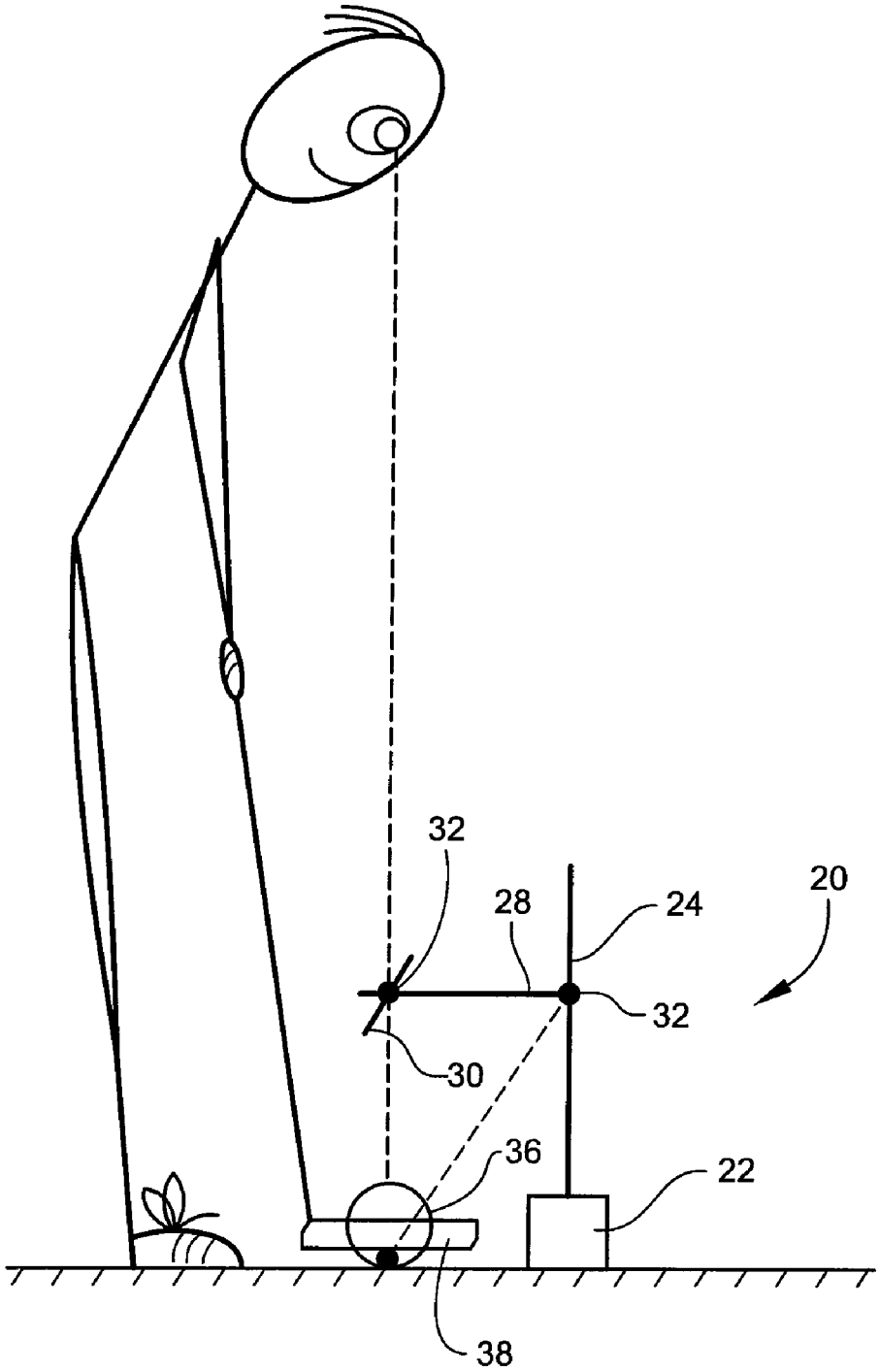
FIG. 3 is a side environmental view illustrating the preferred alignment of the dominant eye.

Referring to FIG. 3, this particular illustration shows a golfer addressing the golf ball 36 and in the proper position over the ball, with the dominant eye positioned perpendicularly over the rear of the ball 36, and in vertical alignment with the back of the ball and the crosshair. As stated above, the spot 60 may not be visible once the ball is positioned on the putting surface, thus the crosshair and the back of the ball are the visual alignment members. The putter head 38 is further shown properly flush to the putting surface.

Figure 4:
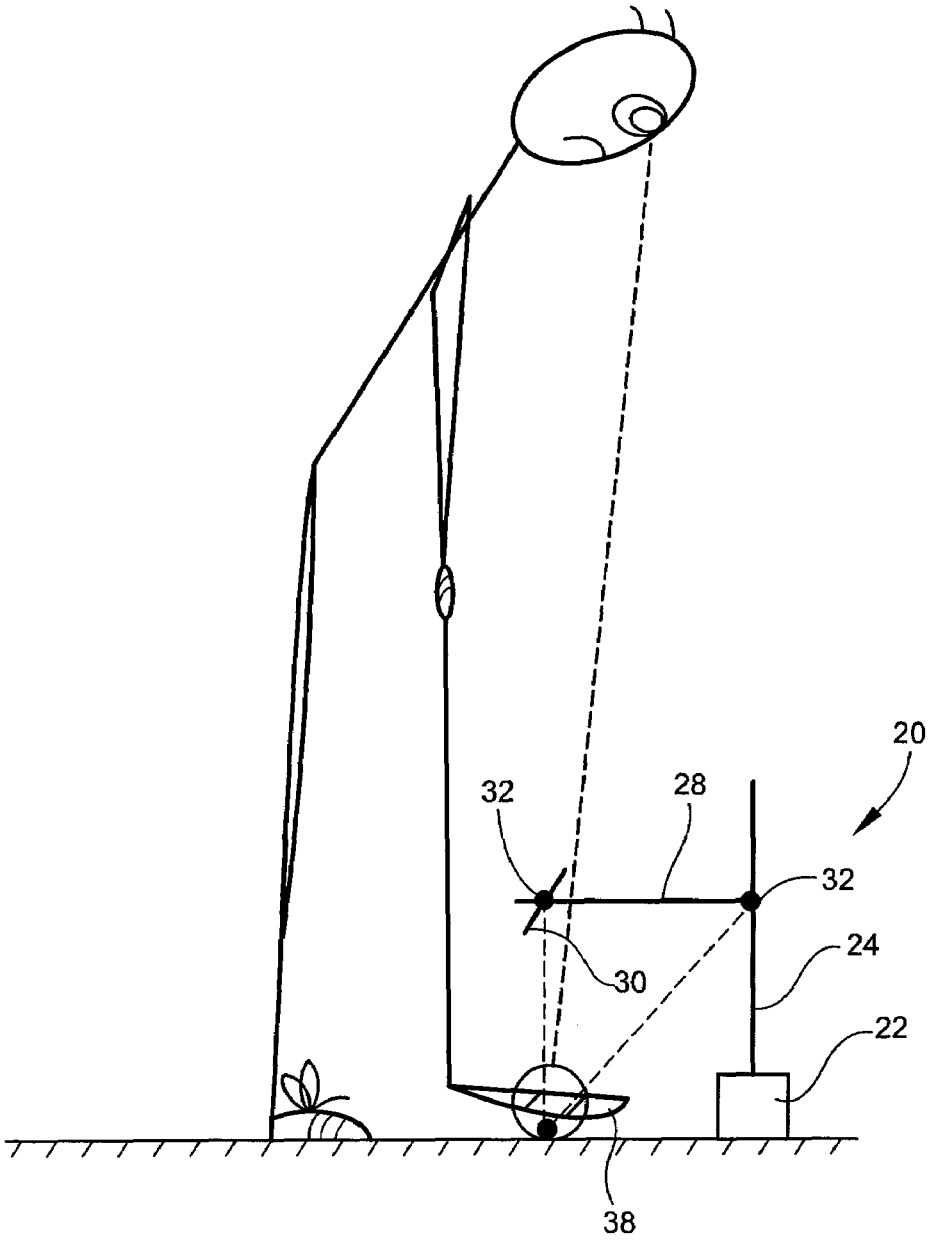
FIG. 4 is a side environmental view illustrating an alternative alignment of the dominant eye.

Referring to FIG. 4, alternative alignment of the dominant eye is shown outwardly of the proper vertical alignment position, making it appear to the golfer that the golf ball 36 is not bisected by the cross member 30. In this position, the golfer's weight is too much on the toes, which may cause the ball to be struck left of the desired direction for a right-handed golfer. Further, the putter head 38 is shown at an angle to the putting surface as opposed to flush. Correction in the stance should be made be shifting more weight back to the heels and moving the dominant eye back relative to the device 20 and in vertical alignment with the intersection of the physical alignment member 26 and the back of the ball.

Figure 5:
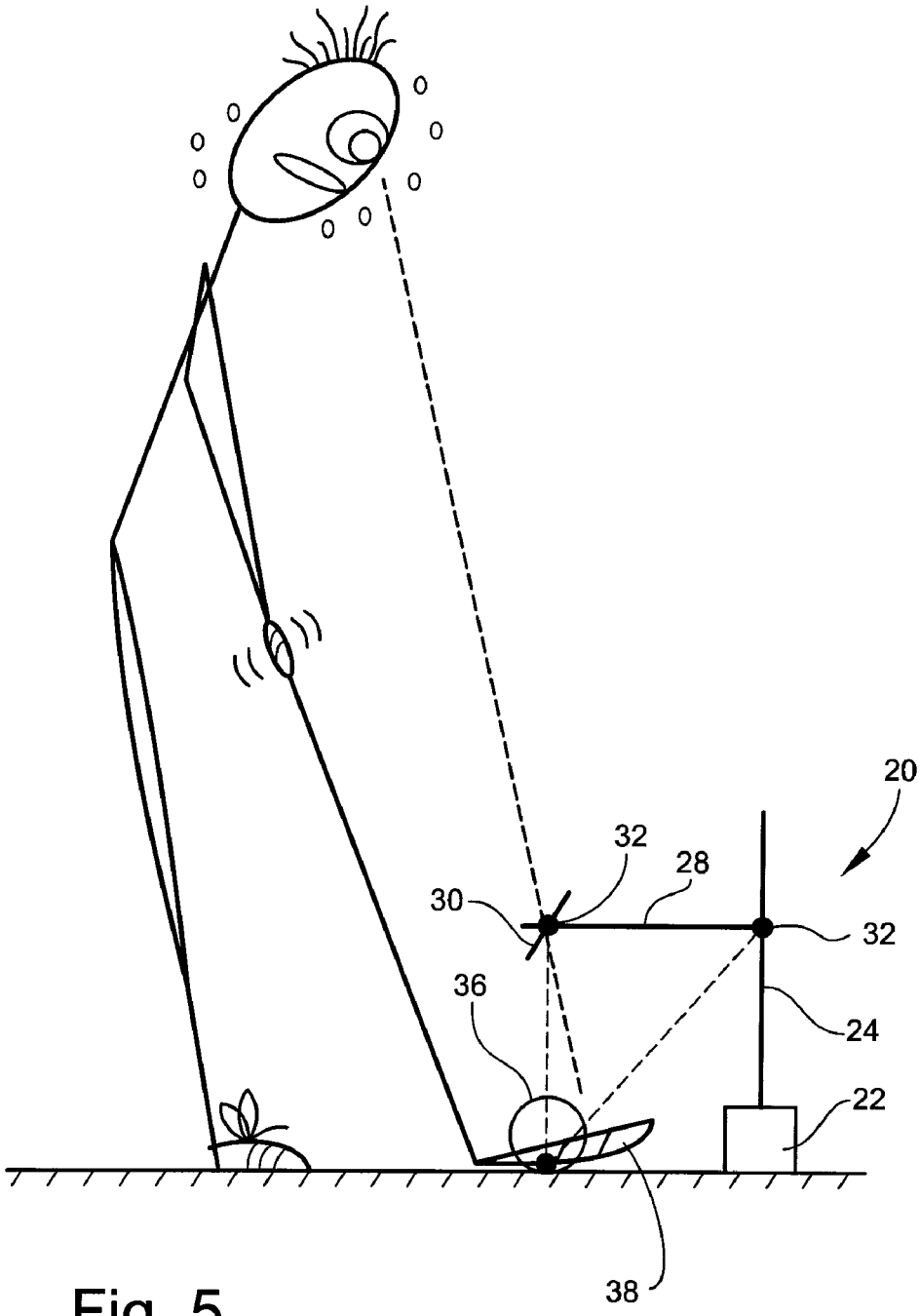
FIG. 5 is a side environmental view illustrating an alternative alignment of the dominant eye.

Referring to FIG. 5, alignment of the dominant eye is shown inwardly of the proper vertical alignment position, making it appear to the golfer that the golf ball 36 is again not bisected by the cross member 30. In this position, the golfer's weight is too much on the heels, which may cause the ball to be struck right of the desired direction for a right-handed golfer. Further, the putter head 38 is shown at an angle to the putting surface as opposed to flush. Correction in the stance should be made be shifting more weight to the toes and moving the dominant eye forward relative to the device 20 and in vertical alignment with the intersection of the physical alignment member 26 and the back of the ball.

Figure 6:
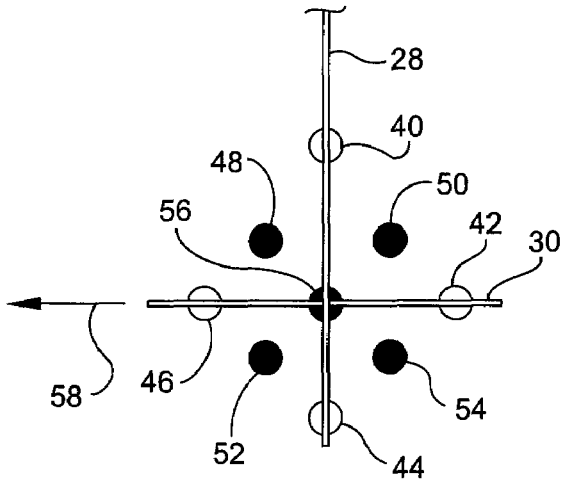
FIG. 6 is a top plan view of a portion of the alignment device of FIG. 1 illustrating line-of-sight eye positions.

Referring to FIG. 6, various eye line positions relative to the intersection of the laterally extending member 28 and cross member 30 of the physical alignment member 26 are schematically illustrated. The direction of the putt, or putting line, is indicated at directional arrow 58. The group of eye line positions represented at 40, 42, 44 and 46 illustrate single line-of-sight eye position deviations. Specifically, 40 represents an eye position deviation outside of preferred, 42 behind preferred, 44 inside of preferred, and 46 forward of preferred. The group of eye line positions represented at 48, 50, 52 and 54 illustrate compound line-of-sight eye position deviations. Specifically, 48 represents an eye position deviation forward and outside of preferred, 50 behind and outside of preferred, 52 forward and inside of preferred, and 54 behind and inside of preferred. Eye position 56 represents the preferred line-of-site eye position vertically below the crosshair.

Figure 7:
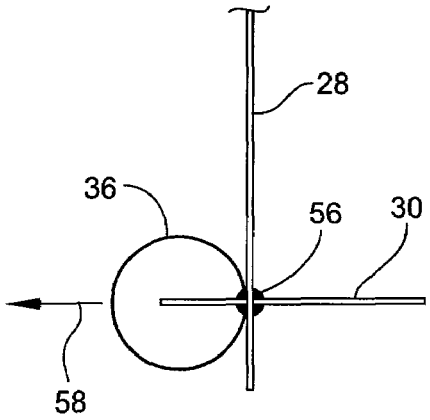
FIG. 7 is a top plan view of a portion of the alignment device of FIG. 1 illustrating substantially bi-directional perpendicular alignment.
Figure 8:
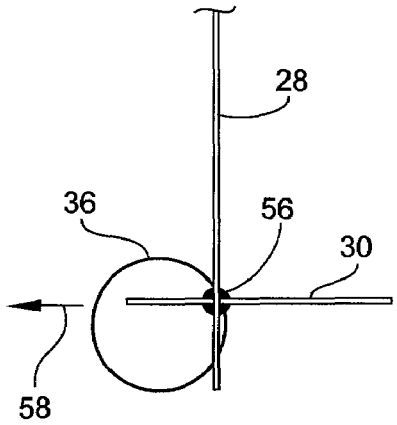
FIG. 8 is a top plan view of a portion of the alignment device of FIG. 1 illustrating an alternative preferred eye alignment.

Referring to FIG. 7, preferred line-of-sight eye positioning is indicated at 56, with the golf ball 36 being positioned with its impact point visually tangent to the crosshair and laterally extending member 28, and with the cross member 30 visually bisecting the ball 36. An alternative line-of-sight eye position, such as those shown in FIG. 6, results in the line-of-sight at an angle to the putting surface. In an alternative position, body position, pendulum action, force and putter direction at impact collectively produce inconsistent results. Referring to FIG. 8, an alternative preferred eye alignment is shown, and more of the ball 36 can be seen below and behind the crosshair. Thus, the alignment device 20 may also be used to determine an eye line position that deviates from true perpendicular, but may be practiced for consistency in addressing the ball 36.

In use, as the golfer practices putting with the alignment device 20 and encounters the misalignments described in this application, corrections can be made by reorienting the dominant eye so as to result in the preferred position. Use of the device 20 permits a golfer to practice putting in a manner that permits association of putts missed to the left or right of the hole with various misalignments as described above and illustrated in the drawings. The base 22 permits the alignment device 20 to be aligned substantially parallel with the ground on which the base 22 rests. Over time, visual feedback and correction permit the golfer to putt during regular play without the alignment device by retaining the mental impression of the proper alignment, thereby increasing the probability of striking the ball in such a manner that the ball travels in the direction actually perceived by the golfer.

An improved golf ball alignment device is described above. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

What is claimed is:

1. A golf ball alignment device, comprising:

a supportive base for being positioned on a putting surface;

an upright member extending vertically upwardly from the base;

a physical alignment member supported by the upright member and extending laterally away therefrom, the physical alignment member including a laterally extending member and a cross member positioned coplanar, the laterally extending member and the cross member intersecting to define a crosshair; and an optical alignment member supported by at least one of the upright member and the physical alignment member, the optical alignment member including a beam-producing light source aimed toward the putting surface to a point vertically below the intersection point of the laterally extending member and the cross member to produce a light spot on the putting surface;

wherein the intersection point of the laterally extending member and the cross member, and the spot are vertically aligned when viewed from above with a dominant eye substantially perpendicular to the putting surface.

2. The alignment device according to claim 1, further comprising a power source housed within the base for supplying power to the light source.

3. The alignment device according to claim 2, wherein at least one of the upright member and the physical alignment member are tubular to permit routing of electrical connections from the power source to the light source therethrough.

4. The alignment device according to claim 2, wherein the power source comprises at least one battery.

5. The alignment device according to claim 1, wherein the spot projected onto the putting surface defines a tangent to the impact point on a golf ball positioned on the putting surface.

6. The alignment device according to claim 1, wherein the cross member visually defines a putting stroke line.

7. The alignment device according to claim 1, wherein the light source includes one of an incandescent bulb, an optical fiber, an LED, and a laser diode.

8. The alignment device according to claim 1, wherein the base defines a shape indicating a direction of the putt.

9. The alignment device according to claim 1, wherein the upright member is rotatable relative to the base.

10. The alignment device according to claim 1, wherein the only light visible to a user properly positioned over the alignment device is the spot on the putting surface produced by the light source.

11. An alignment device for aligning an impact point of a golf ball perpendicular to a dominant eye, comprising:

a base for being positioned on a putting surface;

an upright member extending vertically upwardly from the base;

a physical alignment member extending laterally away from the upright member and defining an alignment crosshair; and an optical alignment member supported on the alignment device and including a powered beam-producing light source aimed toward the putting surface to a point vertically beneath an intersection point of the crosshair such that light from the light source is only visible by a user as a spot of light on the putting surface when viewed from above the alignment device;

wherein the crosshair and the spot are vertically aligned when viewed from above with a dominant eye perpendicular to the putting surface.

12. The alignment device according to claim 11, further comprising battery power source housed within the base for supplying power to the light source.

13. The alignment device according to claim 12, wherein at least one of the upright member and the physical alignment member are tubular to permit routing of electrical connections from the power source to the light source therethrough.

14. The alignment device according to claim 11, wherein the spot projected onto the putting surface defines a tangent to the impact point on a golf ball positioned on the putting surface.

15. The alignment device according to claim 11, wherein the physical alignment member visually defines a putting stroke line.

16. The alignment device according to claim 11, wherein the light source includes one of an incandescent bulb, an optical fiber, an LED, and a laser diode.

17. The alignment device according to claim 11, wherein the upright member is rotatable relative to the base.

* * * * *